US005308174A

United States Patent [19]

Kuki

[11] Patent Number: 5,308,174

[45] Date of Patent: May 3, 1994

[54] TEXT PROCESSING SYSTEM WITH A MOVABLE DISPLAY DEVICE

[75] Inventor: Masakazu Kuki, Ichinomiya, Japan

[73] Assignee: Brother Kogyo Kabushiki Kaisha, Nagoya, Japan

[21] Appl. No.: 980,714

[22] Filed: Nov. 24, 1992

[30] Foreign Application Priority Data

Jan. 8, 1992 [JP] Japan ..... 4-199[U]

[51] Int. Cl.[5] ..... B41J 3/46

[52] U.S. Cl. ..... 400/83; 248/921; 361/681

[58] Field of Search ..... 400/83, 682, 691, 692, 400/693; 361/380, 390, 391, 392, 393, 394, 681, 682; 16/337, 339, 342; 248/917, 918, 919, 920, 921, 922, 923

[56] References Cited

U.S. PATENT DOCUMENTS

| | | | |
|---|---|---|---|
| 4,478,382 | 10/1984 | Carrier | 248/923 |
| 4,620,344 | 11/1986 | Lewis, Jr. | 16/337 |
| 4,781,422 | 11/1988 | Kimble | 16/337 |
| 5,034,858 | 7/1991 | Kawamoto et al. | 361/394 |
| 5,043,846 | 8/1991 | Kinoshita | 361/394 |
| 5,178,481 | 1/1993 | Kawamura | 16/342 |
| 5,211,368 | 5/1993 | Kitamura | 248/923 |

FOREIGN PATENT DOCUMENTS

| | | | |
|---|---|---|---|
| 180385 | 9/1985 | Japan | 358/254 |
| 2223875 | 4/1990 | United Kingdom | 400/83 |

*Primary Examiner*—David A. Wiecking
*Attorney, Agent, or Firm*—Oliff & Berridge

[57] ABSTRACT

A text processing system includes a text processing device having an outer surface treated with coating, plating, printing, etc., a display device movably supported on the text processing device, a circular rotating member rotatably supported on the display device so as to rotationally contact the outer surface of the text processing device, a device for continuously moving the display device relative to the text processing device, and a device for holding the display device in a desired position relative to the text processing device. it is accordingly possible to prevent the peeling-off of the surface treatment layer such as a coating, plating or printing layer formed on the outer surface of the text processing device due to the contact between the lower end portion of the display device and the outer surface of the text processing device.

20 Claims, 6 Drawing Sheets

TEXT PROCESSING SYSTEM WITH A MOVABLE DISPLAY DEVICE

BACKGROUND OF THE INVENTION

1. Field of the Invention

The present invention relates to a text processing system having a text processing device and a display device movably connected to the text processing device.

2. Description of Related Art

In a conventional text processing system for creating a text with use of a keyboard and a display device and for printing the text thus created, it is known to movably connect the display device to a text processing device.

FIG. 8 is an enlarged partial sectional view of an essential part of such a conventional text processing system 80. Referring to FIG. 8, reference numerals 82 and 84 designate a display device and a text processing device, respectively. In the condition shown in FIG. 8, a lower end portion 83 of the display device 82 is in contact with an upper surface 85 of the text processing device 84 treated with coating, plating, printing, etc.

However, when the display device 82 is moved in the direction of the arrow shown in FIG. 8 with the lower end portion 83 being maintained in contact with the upper surface 85 of the text processing device 84, the lower end portion 83 of the display device 82 slides or slips on the upper surface 85 of the text processing device 84, causing a problem that the surface treatment layer of coating, plating, printing, etc. formed on the upper surface 85 is peeled off.

SUMMARY OF THE INVENTION

It is accordingly an object of the present invention to provide a text processing system which can prevent the peeling-off of the surface treatment layer such as a coating, plating or printing layer formed on the outer surface of the text processing device due to the contact between the lower end portion of the display device and the outer surface of the text processing device.

According to the present invention, there is provided a text processing system comprising a text processing device having an outer surf ace treated with coating, plating, printing; a display device movably supported on the text processing device; a circular rotating member rotatably supported on the display device so as to rotationally contact the outer surf ace of the text processing device; means for continuously moving the display device relative to the text processing device; and means for holding the display device in a desired position relative to the text processing device.

With this construction, the display device is movably connected to the text processing device of the text processing system. The outer surf ace of the text processing device is treated with coating, plating, printing, etc. The circular rotating member is rotatably supported to the display device so that the former can rotationally contact the outer surf ace of the text processing device. When the display device is moved relative to the text processing device under the condition where the circular rotating member is maintained in contact with the outer surface of the text processing device, the circular rotating member is rotated or rolled on the outer surface of the text processing device during the movement of the display device. Accordingly, the display device does not directly contact the outer surf ace of the text processing device, so that wearing of the outer surface of the text processing device due to the sliding of the lower end portion of the display device thereon can be avoided.

Other objects and features of the invention will be more fully understood from the following detailed description and appended claims when taken with the accompanying drawings.

DESCRIPTION OF PREFERRED EMBODIMENTS

Preferred embodiments of the present invention will now be described with reference to the drawings.

Figure 1:
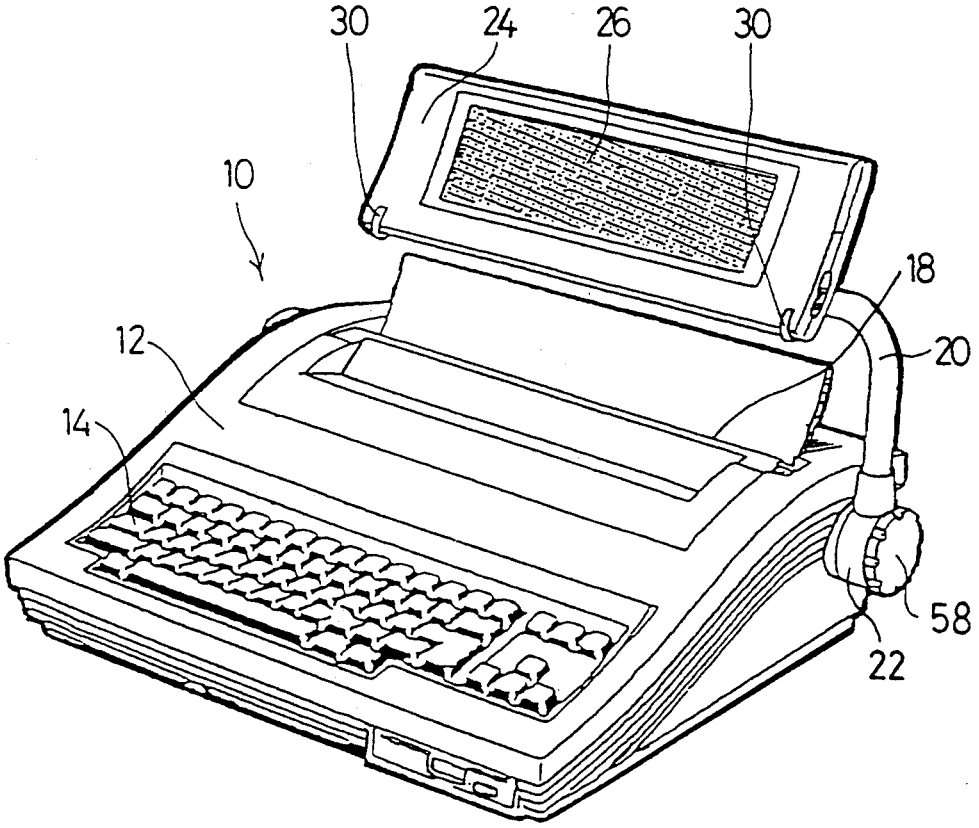
FIG. 1 is a perspective view of a text processing system in a preferred embodiment according to the present invention.

Referring to FIG. 1, reference numeral 10 generally designates a text processing system according to the present invention. The text processing system 10 includes a text processing device 12 and a keyboard 14 provided at a front portion of the text processing device 12 on the upper side thereof for inputting characters. Behind the keyboard 14 an opening portion 18 is formed having a paper eject opening for ejecting printed paper on which a text has been printed and a paper insert opening for inserting printing paper on which a text is to be printed. An outer surface of the text processing device 12 has a treatment layer thereon, such as coating, plating, printing or the like.

On the right side of the text processing device 12 as seen in FIG. 1, an arm pipe 20 is mounted through a joint 22 so as to be rotatable about a horizontal axis with respect to the text processing device 12.

Figure 2:
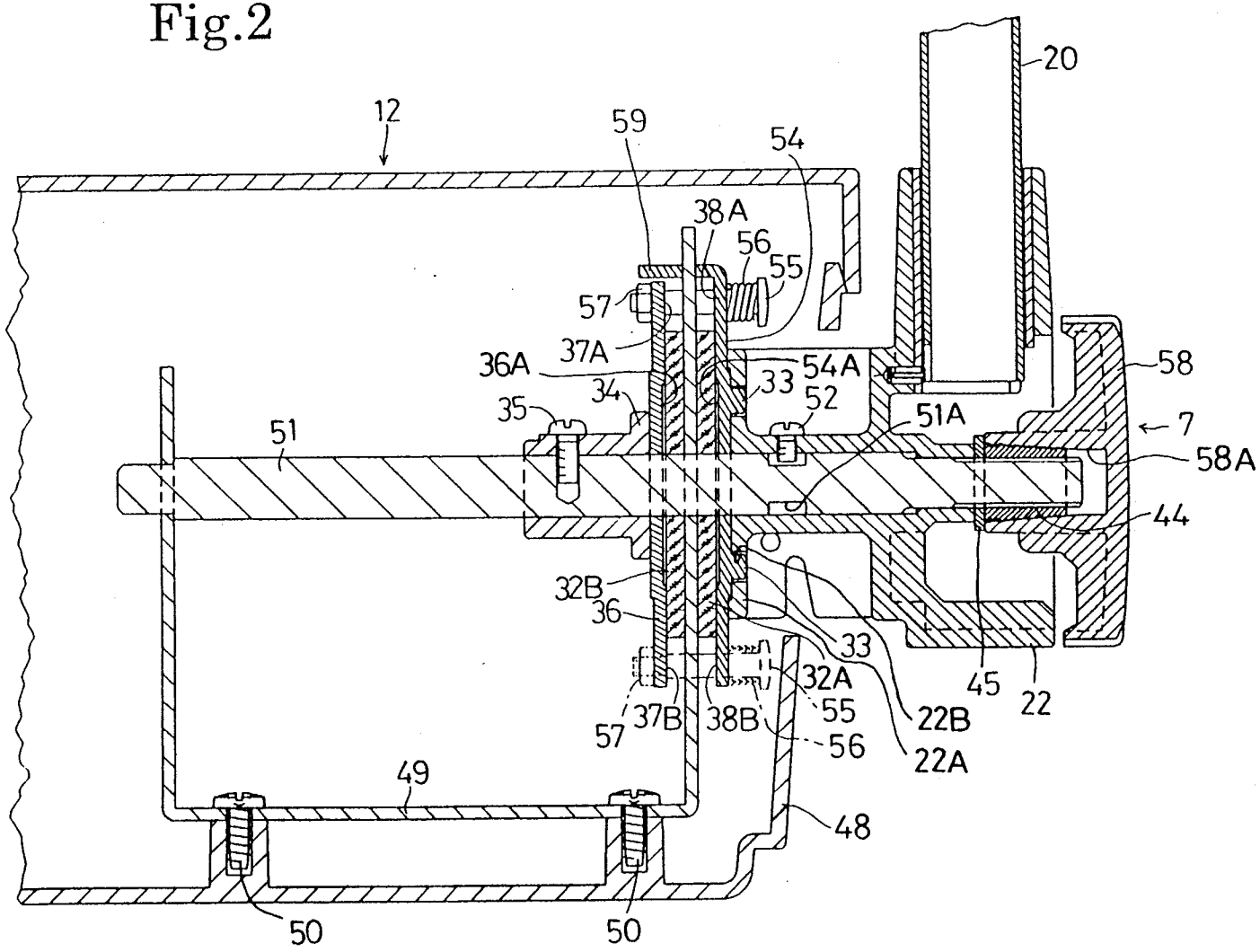
FIG. 2 is an enlarged partial sectional view, partially broken away, of a supporting device for supporting a display device to a text processing device on the text processing system shown in FIG. 1.

There is shown in FIG. 2 a supporting device 7 for rotatably supporting the arm pipe 20. Reference numeral 48 designates a lower cover of the text processing device 12, and reference numeral 49 designates a U-shaped frame of the supporting device 7. The frame 49 is fixed to the lower cover 48 by means of screws 50. A horizontal arm shaft 51 is fixed to the frame 49. The joint 22 is rotatably mounted on the arm shaft 51, and the arm pipe 20 is fixed to the joint 22. As shown in FIG. 1, a display device 24 of the text processing system 10 is supported to the arm pipe 20.

The arm shaft 51 is formed with an outer circumferential groove 51*a* having a given width. A screw 52 is threadedly engaged through an aperture in the joint 22 so as to be inserted in the outer circumferential groove 51*a* of the arm shaft 51 so that the joint 22 is prevented from being axially disengaged from the arm shaft 51.

However, a slight axial movement is permitted by the given width of the outer circumferential groove 51*a*.

A first friction plate 54 having an annular shape is rotatably and axially slidably mounted at a central portion thereof on the arm shaft 51 on the left side (as viewed in FIG. 2) of the joint 22. The first friction plate 54 is formed with two through holes 38A and 38B at an outer circumferential portion thereof, circumferentially spaced a given distance, for respectively receiving two shoulder bolts 55 to be hereinafter described.

A left side surf ace (as viewed in FIG. 2) of the first friction plate 54 acts as a frictional contact surface with respect to a first cork plate 32A to be hereinafter described and is formed with an annular recess 54A near the central portion thereof. Accordingly, the outer circumferential portion of the first friction plate 54 radially inside of the through holes 38A and 38B is maintained in frictional contact with the first cork plate 32A.

A right side surface (as viewed in FIG. 2) of the first friction plate 54 acts as a contact surface with respect to a flange portion 22A of the joint 22 and is provided with four radially spaced projections 33. The flange portion 22A of the joint 22 is formed with four holes 22B for respectively engaging the four projections 33 of the first friction plate 54. Thus, the first friction plate 54 is rotatably connected together with the joint 22.

Further, the first friction plate 54 is integrally formed with a rotation stopper 59 extending perpendicularly from the outer circumferential portion near the through hole 38A in the left direction as viewed in FIG. 2, so as to interfere with an upper end portion of the frame 49.

Owing to the provision of the rotation stopper 59, an angle of rotation of the first friction plate 54 together with the joint 22 is limited to about 100 degrees between a position shown in FIG. 2 where the rotation stopper 59 contacts the upper end portion of the frame 49 and another position where the rotation stopper 59 contacts a lower portion of the frame 49 below the arm shaft 51. The limitation of the rotational angle of the first friction plate 54 permits limited movement of the display device 24 connected through the arm pipe 20 and the joint 22 to the first friction plate 54 between a condition where a display surface 26 of the display device 24 faces an upper surface of the text processing device 12 just behind the keyboard 14 and another condition where the display device 24 is located over the upper surface of the text processing device 12 at a rear portion thereof.

The first cork plate 32A having an annular shape is rotatably mounted at a central portion thereof on the arm shaft 51 between the first friction plate 54 and the frame 49.

Further, an axial stopper 34 is fixed by a screw 35 on the arm shaft 51 between two vertically standing portions of the frame 49.

A second friction plate 36 and a second cork plate 32B are rotatably mounted at their central portions on the arm shaft 51 between the axial stopper 34 and the frame 49.

The second friction plate 36 is formed at an outer circumferential portion thereof with two tapped holes 37A and 37B circumferentially spaced a given distance, for respectively threadedly engaging the two shoulder bolts 55.

A right side surface (as viewed in FIG. 2) of the second friction plate 36 acts as a frictional contact surface of the second friction plate 36 with respect to the second cork plate 32B and is formed with an annular recess 36A near the central portion. Accordingly, the outer circumferential portion of the second friction plate 36 radially inside of the tapped holes 37A and 37B is maintained in frictional contact with the second cork plate 32B.

Each shoulder bolt 55 has a threaded end portion, a head portion, and an intermediate portion between the threaded end portion and the head portion. The threaded end portions of the two shoulder bolts 55 are threadedly engaged with the tapped holes 37A and 37B of the second friction plate 36, respectively, and the intermediate portion of the two shoulder bolts 55 are loosely inserted through the through holes 38A and 38B of the first friction plate 54, respectively. Further, two compression springs 56 are provided around the intermediate portions of the two shoulder bolts 55 so as to be sandwiched between the head portions of the two shoulder bolts 55 and the first friction plate 54, respectively. Further, two nuts 57 are fastened to the threaded end portions of the two shoulder bolts 55 to firmly lock the second friction plate 36 with respect to the two shoulder bolts 55, respectively. Accordingly, the second friction plate 36 is rotatable together with the first friction plate 54.

The first friction plate 54 is normally biased by given biasing force of the compression springs 56 in an axial direction of the arm shaft 51. The biasing force of the compression springs 56 defines the strength of the maximum frictional force to be generated between the contact surfaces of the frame 49 and the first cork plate 32A, between the contact surfaces of the frame 49 and the second cork plate 32B, between the contact surfaces of the first cork plate 32A and the first friction plate 54, and between the contact surfaces of the second cork plate 32B and the second friction plate 36. The frictional force to be thus generated enables the display device 24 to be held in position with respect to the text processing device 12, and permits rotation of the display device 24 about the arm shaft 51 to an arbitrary position within the limited rotational angle mentioned previously when an external force is applied to the display device 24.

An externally threaded member 44 is fixedly engaged with a right end portion (as viewed in FIG. 2) of the arm shaft 51, and a washer 45 is axially slidably interposed between the externally threaded member 44 and the joint 22. A knob 58 having an internally threaded bore 58A is fastened to the externally threaded member 44 so as to axially urge the joint 22 against the washer 45.

By adjusting a fastening degree of the knob 58 to the externally threaded member 44 by rotating the knob 58 to tighten it against the washer 45, all of the first friction plate 54, the first cork plate 32A, the frame 49, the second cork plate 32B and the second friction plate 36 can be maintained in frictional contact with each other by a fastening force of the knob 58 which is larger than the biasing forces of the compression springs 56.

The fastening force of the knob 58 defines the strength of the frictional force to be generated between the contact surfaces of the frame 49 and the first cork plate 32A, between the contact surfaces of the frame 49 and the second cork plate 32B, between the contact surfaces of the first cork plate 32A and the first friction plate 54, and between the contact surfaces of the second cork plate 32B and the second friction plate 36. The frictional force to be generated upon fully fastening or tightening the knob 58 is large enough to fix the display device 24 in a stationary position. Accordingly, when the knob 58 is fully fastened, the display device 24 is fixed in an arbitrary position with respect to the text processing device 12 by the frictional forces due to the fastening force even when an external force is applied to the display device 24.

As shown in FIG. 1, the arm pipe 20 upwardly extending from the joint 22 is bent leftwardly as viewed in FIG. 1 to extend in parallel to the upper surface of the text processing device 12.

As shown in FIGS. 4 to 7, a supporting portion 28 is formed on a back surface of the display device 24 opposite to the display surface 26 at a lower portion thereof. The supporting portion 28 of the display device 24 is rotatably engaged with a horizontally extending portion 21 of the arm pipe 20. A rubber sheet is interposed between the supporting portion 28 and the horizontally extending portion 21 in order to provide a degree of resistance to rotation of the display device 24 about the horizontally extending portion 21. That is, if an external force is not applied to the display device 24, the display device 24 is held in a desired rotational position by this resistance.

In this manner, the display device 24 is supported through the arm pipe 20 and the joint 22 on the text processing device 12 so as to be movable between the low position where the display surface 26 of the display device 24 faces the upper surface of the text processing device 12 and the high position where the display device 24 is located over the upper surface of the text processing device 12 at the rear portion thereof. Furthermore, the display device 24 is rotatably supported on the horizontally extending portion 21 of the arm pipe 20 so that a tilt angle of the display surface 26 may be changed to a desired moving position obtained by the rotation of the arm pipe 20.

Figure 3:
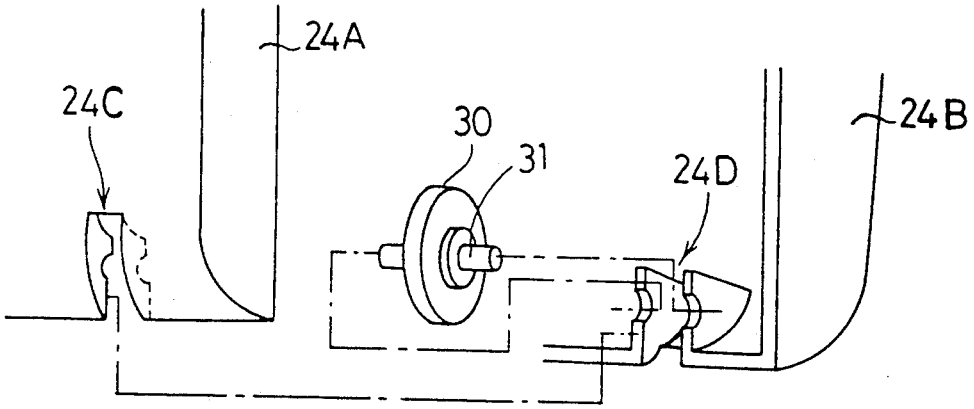
FIG. 3 is an exploded partial perspective view of a supporting mechanism for a circular rotating member according to the present invention.

As shown in FIGS. 1 and 3, a pair of circular rotating members 30 are rotatably supported on a lower end portion of the display device 24 near laterally opposite ends thereof. The display device 24 includes a front half cover 24A on the side of the display surface 26 and a rear half cover 24B on the opposite side of the display surface 26. The front half cover 24A is provided with a pair of supporting portions 24C including two spaced walls with aligned grooves therein (one of which is shown in FIG. 3), and the rear half cover 24B is similarly provided with a pair of supporting portions 24D (one of which is shown in FIG. 3) respectively mating with the supporting portions 24C to define a channel for receiving a rotating member 30. A shaft portion 31 extending from each side of each circular rotating member 30 is rotatably supported in the mating supporting portions 24C and 24D. Each rotating member 30 protrudes from the bottom of the display device 24 from between the spaced walls of the supporting portions **24*c* and 24*d***.

Figure 4:
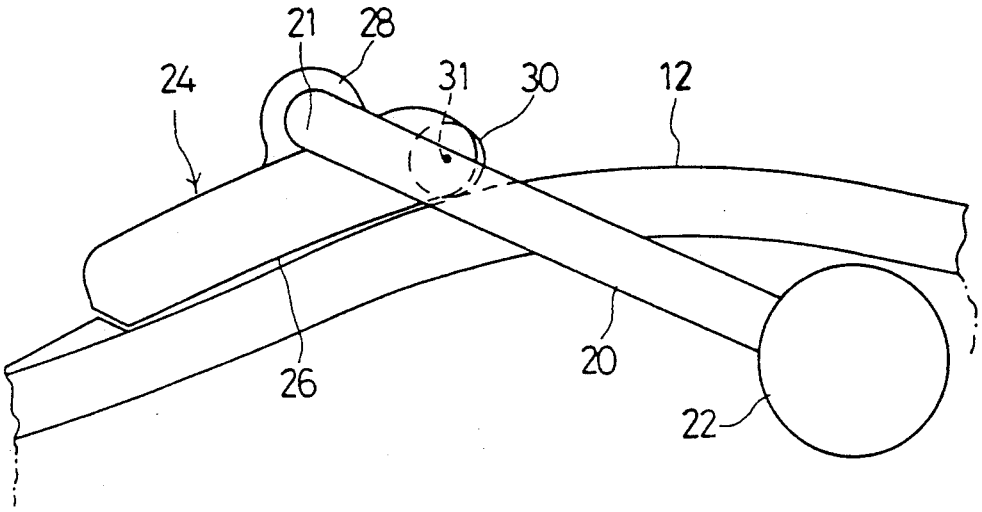
FIGS. 4, 5, 6 and 7 are partial side views illustrating various conditions of the display device relative to the text processing device.
Figure 5:
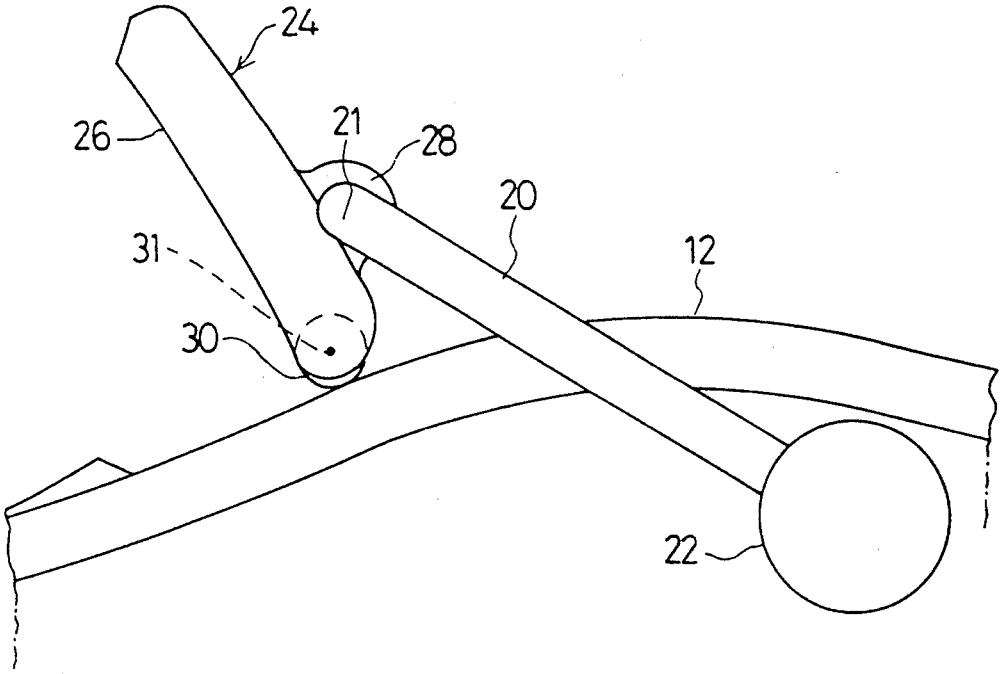
Figure 6:
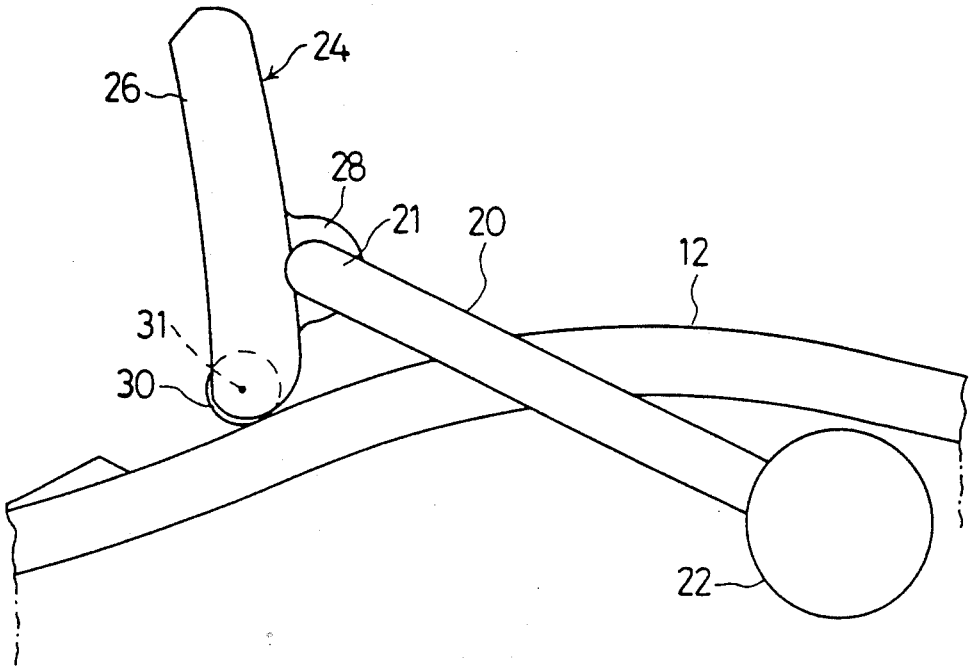

As shown in FIGS. 4 to 6, the outer circumference of each circular rotating member 30 projects from both the front surface and lower end surface of the display device 24. Accordingly, when rotating the display device 24 about the horizontally extending portion 21 of the arm pipe 20 from a substantially horizontal position to a substantially vertical position with respect to the display surface 26, and when of moving the display device 24 substantially horizontally with the display surface 26 being directed downwardly, the outer circumference of each circular rotating member 30 contacts and rolls over the upper surface of the text processing device 12. Accordingly, it is possible to prevent the display device 24 from directly contacting the upper surface of the text processing device 12.

Each circular rotating member 30 is preferably formed of polypropylene, and the housing of the text processing device 12 is preferably formed of polystyrene. That is, each circular rotating member 30 is softer in material than the housing of the text processing device 12 so that the rotating member is relatively resilient. Accordingly, each circular rotating member 30 can be easily rolled on the upper surface of the text processing device 12 without sliding. Although each circular rotating member 30 directly contacts the upper surf ace of the text processing device 12 and moves together with the display device 24 on the upper surface of the text processing device 12, each circular rotating member 30 is easily rotated about the axis of the shaft portion 31 and does not rub or slide on the upper surf ace of the text processing device 12. Therefore, even when the circular rotating members 30 come into contact with the upper surface of the text processing device 12, the upper surface of the text processing device 12 is not damaged or worn by the circular rotating members 30.

Alternatively, the rotating member may be formed as a ball rotationally supported in a socket-like formation in the cover or on an articulating joint to provide rotation in all directions.

The operation of the above preferred embodiment will now be described with reference to FIGS. 4 to 7.

FIG. 4 shows an initial condition of the display device 24 of the text processing system 10. In the initial condition, the display device 24 is held in such a position that the display surface 26 is directed downwardly in a substantially parallel relationship to the upper surface of the text processing device 12. In this condition, the outer circumference of each circular rotating member 30 projecting from the front surface (on the side of the display surface 26) of the display device 24 is maintained in contact with the upper surface of the text processing device 12.

In the case of obtaining the condition shown in FIG. 6 from the initial condition shown in FIG. 4 by applying an external force to the display device 24, the display device 24 is rotated about the horizontally extending portion 21 of the arm pipe 20 via the condition shown in FIG. 5 to the substantially vertical condition shown in FIG. 6 where the display surface 26 is directed to the front side of the text processing device 12. During the rotation of the display device 24, the outer circumference of each circular rotating member 30 is maintained in contact with the upper surf ace of the text processing device 12, and each circular rotating member 30 is rotated about the axis of the shaft portion 31. Therefore, the upper surface of the text processing device 12 treated with coating is not worn by the display device 24. Furthermore, each rotating member 30 is rotated about the axis of the shaft portion 31 in contact with the upper surf ace of the text processing device 12 without sliding during the rotation of the display device 24. Therefore, the upper surface of the text processing device 12 treated with coating is not worn by each circular rotating member 30.

Figure 7:
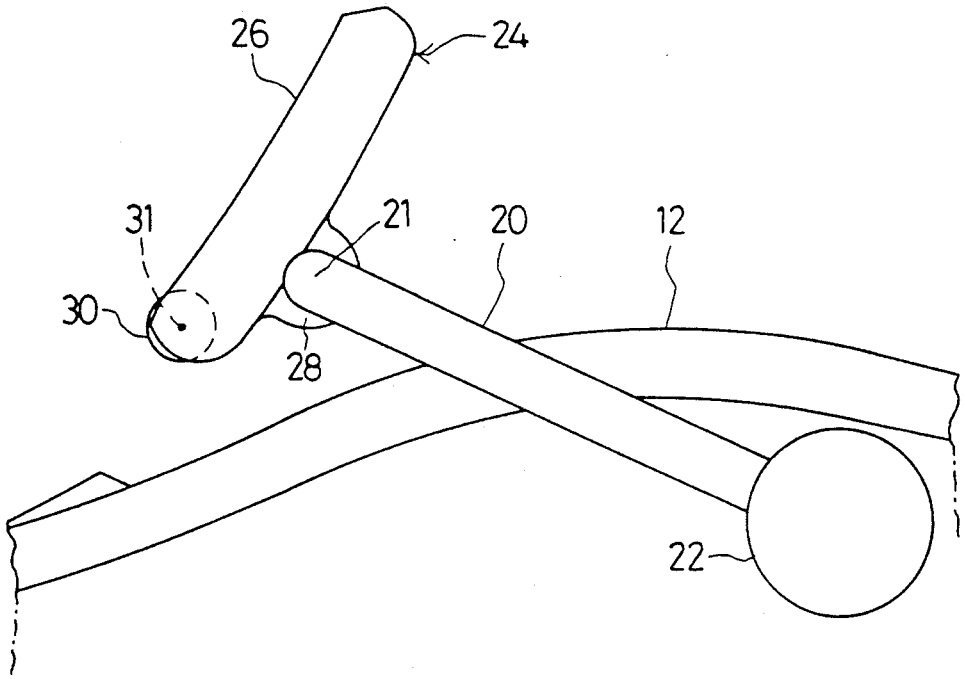
Figure 8:
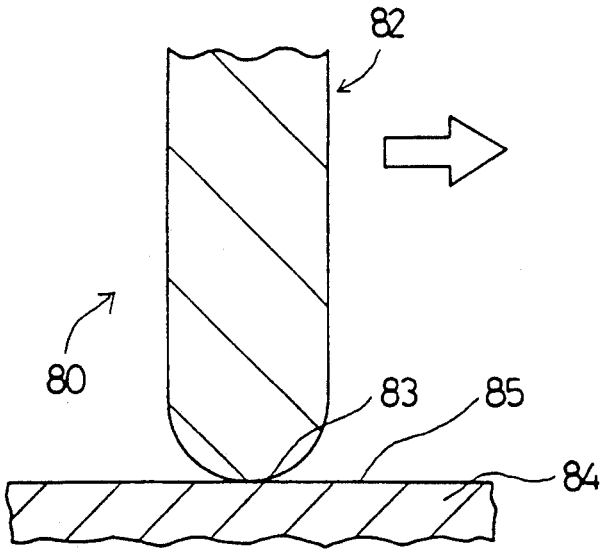
Fig.8 RELATED ART
FIG. 8 is an enlarged sectional view illustrating a condition where a lower end portion of a display device is in contact with an outer surface of a text processing device treated with coating, plating or printing in a conventional text processing system.

When the display device 24 held in the substantially vertical condition shown in FIG. 6 is further rotated about the horizontally extending portion 21 of the arm pipe 20, the display surface 26 can be directed to a desired position as shown in FIG. 7.

In this manner, even when the display device 24 is moved, the upper surface of the text processing device 12 is not worn by the display device 24 and the circular rotating members 30. Accordingly, the coating layer formed on the upper surface of the text processing device 12 is not peeled off, and a good appearance of the text processing device 12 can be maintained irrespective of frequent movement of the display device 24.

As apparent from the above description, in the text processing system according to the present invention, even when the display device is frequently moved by the operator, it is prevented from directly contacting the outer surface of the text processing device treated with coating, plating or printing. Accordingly, such coating, plating or printing layer formed on the outer surface of the text processing device is prevented from being worn by the display device. Thus, the appearance of the text processing system can be maintained in a good condition, and the operator can efficiently and comfortably operate the text processing system.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

What is claimed is:

1. A text processing apparatus, comprising:

a text processing device having an exterior surface with a treatment thereon;

a display device coupled to said text processing device, said display device having an exterior surface;

support means coupled to said text processing device and said display device for selectively movably supporting said display device with respect to said text processing device; and rotational means coupled to said display device and independent of said support means for providing rotational contact between said exterior surface of said text processing device and said display device.

2. The text processing apparatus of claim 1, wherein said rotational means comprises a rotating surface disposed on said exterior surface of said display device.

3. The text processing apparatus of claim 2, wherein said rotational means comprises at least one roller coupled to said display device.

4. The text processing apparatus of claim 2, wherein said rotational means comprises at least one rotating member formed of resilient material.

5. The text processing apparatus of claim 1, wherein said exterior surface of said display comprises a cover with at least one aperture therein and said rotational means comprises at least one rotating member disposed in said aperture and protruding outwardly from said cover.

6. The text processing apparatus of claim 1, wherein said support means comprises a support arm coupled to said display device, a shaft coupled to said text processing device, and rotatable joint means coupled between said support arm and said shaft including friction means for releasably engaging said support arm to said shaft in a plurality of positions.

7. The text processing apparatus of claim 6, wherein said rotational means comprises a rotating surface disposed on a surface of said display device.

8. The text processing apparatus of claim 7, wherein said rotational means comprises at least one rotating member formed of resilient material.

9. The text processing apparatus of claim 6, wherein said shaft has a circumferential groove with axially spaced sides, and said rotatable joint means has a fastening member, said fastening member being secured in said circumferential groove and said rotatable joint means being axially movable with respect to said shaft between said spaced sides.

10. The text processing apparatus of claim 6, wherein said text processing device has a frame, said shaft being fixedly secured to said frame and said friction means being coupled to said frame, wherein said friction means comprises a first friction plate rotatably mounted on said shaft, a first resilient plate rotatably mounted on said shaft in contact with and between said frame and said first friction plate, a second friction plate rotatably mounted on said shaft and a second resilient plate rotatably mounted on said shaft and in contact with and between said frame and said second friction plate, said first and second friction plates rotatably secured together with said first and second resilient plates therebetween and said first friction plate being biased toward said second friction plate.

11. The text processing apparatus of claim 10, wherein said first and second friction plates are secured together by a pair of fasteners and are biased toward each other by a compression spring.

12. The text processing apparatus of claim 10, wherein said first and second friction plates each have a central annular recess and an outer surrounding circumferential friction surface which contacts said first and second resilient plates, respectively.

13. The text processing apparatus of claim 10, wherein said first and second resilient plates are formed of cork.

14. The text processing apparatus of claim 10, wherein said first friction plate has a flange extending therefrom toward and beyond said frame to limit rotation of said friction means with respect to said shaft.

15. The text processing apparatus of claim 6, further comprising a knob adjustably, threadedly engaged on said shaft and an axial stopper fixedly secured to said shaft, said rotatable joint means being located on said shaft between said knob and said stopper and said friction means being adjustable by said threaded knob.

16. A display device for use with a support having an exterior surface, comprising:

a cover;

a display supported by said cover;

support means coupled to said cover for selectively movably coupling the display device to the support; and rotational means coupled to said cover and independent of said support means for providing rotational contact between said cover and the exterior surface of the support.

17. The display device of claim 16, wherein said rotational means comprises at least one rotating member having at least one rotational axis.

18. The display device of claim 16, wherein said rotational means comprises at least one roller rotatably supported on and protruding from said cover.

19. The display device of claim 16, wherein said cover includes a supporting portion defining a channel therein for receiving and rotatably supporting said rotational means.

20. The display device of claim 16, wherein said rotational means comprises at least one rotating member formed of a resilient material.

* * * * *